United States Patent [19]

Fluck

[11] Patent Number: 4,611,705

[45] Date of Patent: Sep. 16, 1986

[54] APPARATUS FOR SEPARATING ARTICLE GROUPS OF PREDETERMINED LENGTH FROM A CONTINUOUSLY ADVANCED ARTICLE STACK

[75] Inventor: René Fluck, Schleitheim, Switzerland

[73] Assignee: SIG Schweizerische Industrie-Gesellschaft, Neuhausen am Rheinfall, Switzerland

[21] Appl. No.: 761,379

[22] Filed: Jul. 30, 1985

[30] Foreign Application Priority Data

Jul. 31, 1984 [CH] Switzerland ..... 3704/84

[51] Int. Cl.[4] ..... B65G 47/26

[52] U.S. Cl. ..... 198/425; 53/542; 198/426; 414/49

[58] Field of Search ..... 198/408, 409, 415, 416, 198/418, 424–426, 429, 430; 414/48, 49, 80, 104, 107, 108; 53/532, 542

[56] References Cited

U.S. PATENT DOCUMENTS

| | | | |
|---|---|---|---|
| 2,954,881 | 10/1960 | Hopton et al. | 198/418 X |
| 3,127,029 | 3/1964 | Luginbuhl | 198/425 |
| 3,930,572 | 1/1976 | Fluck et al. | 198/425 X |
| 4,082,176 | 4/1978 | Pommer | 198/425 X |
| 4,098,392 | 7/1978 | Greene | 198/425 |
| 4,296,590 | 10/1981 | Focke | 198/425 X |
| 4,394,899 | 7/1983 | Fluck | 198/425 X |

FOREIGN PATENT DOCUMENTS

| | | | |
|---|---|---|---|
| 0077753 | 9/1982 | European Pat. Off. | 198/425 |
| 2259769 | 8/1975 | France | 198/425 |
| 0165619 | 12/1981 | Japan | 198/425 |
| 7807309 | 3/1979 | Netherlands | 198/425 |
| 0476598 | 9/1969 | Switzerland | 198/425 |
| 1387959 | 3/1975 | United Kingdom . | |

*Primary Examiner*—Joseph E. Valenza
*Assistant Examiner*—Lyle Kim
*Attorney, Agent, or Firm*—Spencer & Frank

[57] ABSTRACT

An apparatus for separating article groups of predetermined length from an article stack of indefinite length, comprises a conveyor for advancing the article stack in a conveying direction; a pickup element arranged for a back-and-forth displacement parallel to the conveying direction and for being periodically abutted by a momentarily leading article of the stack; and at least two separating elements upstream of the pickup element and spaced from one another parallel to the conveying direction. The separating elements are moved towards the conveyor to introduce them into the article stack for forming a first article group between two separating elements and a second article group between the pickup element and the separating element adjacent the pickup element. The separating elements are also moved in synchronism with the pickup element, in the conveying direction away from the conveyor. The separating elements push the article groups onto a transfer tray which periodically deposits the article groups onto a further conveyor.

7 Claims, 5 Drawing Figures

APPARATUS FOR SEPARATING ARTICLE GROUPS OF PREDETERMINED LENGTH FROM A CONTINUOUSLY ADVANCED ARTICLE STACK

BACKGROUND OF THE INVENTION

This invention relates to an apparatus for separating article groups of predetermined length from a stack of flat, edgewise upright oriented, continuously advanced articles such as confectionary wafers. The length of the groups is determined by the distance between a separating element which may be introduced between two consecutive articles of the stock and a pickup element which is movable parallel to the article advance and which is situated at the downstream end of the momentarily formed group. The apparatus further includes a transfer tray for transferring the groups to a further conveyor device.

Several solutions have been proposed in the past concerning a grouped packaging of flat, wafer-like articles. Thus, it is known to introduce between the edgewise upright oriented articles a knife-like or lance-like separating element and, at the same time, to position, at the downstream end of the article group, a pickup element movable parallel to the article advance. The distance between the separating element and the pickup element determines the length of the group. Such apparatuses are disclosed, for example, in Swiss Pat. No. 380,635, German Gebrauchsmuster No. 7,223,053 and U.S. Pat. No. 2,954,881.

In the apparatus disclosed in U.S. Pat. No. 4,098,392 the articles advanced continuously by a first conveyor are withheld by a separating blade while the articles downstream of the blade (that is, the separated articles) are furthr conveyed by means of an article carrier. A second article carrier associated with the first-named article carrier to form a pair therewith retains the leading article of the stack at a distance from the counted group and constitutes a component comparable to the pickup elements of the machines disclosed in the above-listed three other publications. In this manner a continous group division is obtained in a linear conveyor path.

The mechanism for forming a simple distance between articles is relatively complex. Adjustments for changing the number of articles per group which may be a required daily to maintain the number of articles constant in case the type of articles is changed, may be effected only with complicated means.

Further, in up-to-date packages it is often a desideratum to simultaneously pack several groups, for example, in case packaging boxes are provided with shock absorbing partitions. None of the grouping apparatuses described above permit a simultaneous separation of a plurality of groups from a single continuous article stack and a simultaneous further conveyance of such groups.

SUMMARY OF THE INVENTION

It is an object of the invention to provide an improved apparatus of the above-outlined type with which the discussed shortcomings are eliminated.

This object and others to become apparent as the specification progresses, are accomplished by the invention, according to which, briefly stated, there are provided at least two separating elements and a pickup element downstream thereof, for simultaneously forming at least two groups from articles belonging to one and the same stack. One group is formed by two adjacent separating elements and another group is formed between the last downstream separating element and the pickup element. The distances between adjacent separating elements and between the pickup element and the last separating element are approximately identical. Further, means are provided at a transfer tray to transfer the separated groups distanced from one another.

DESCRIPTION OF THE PREFERRED EMBODIMENT

Figure 1:
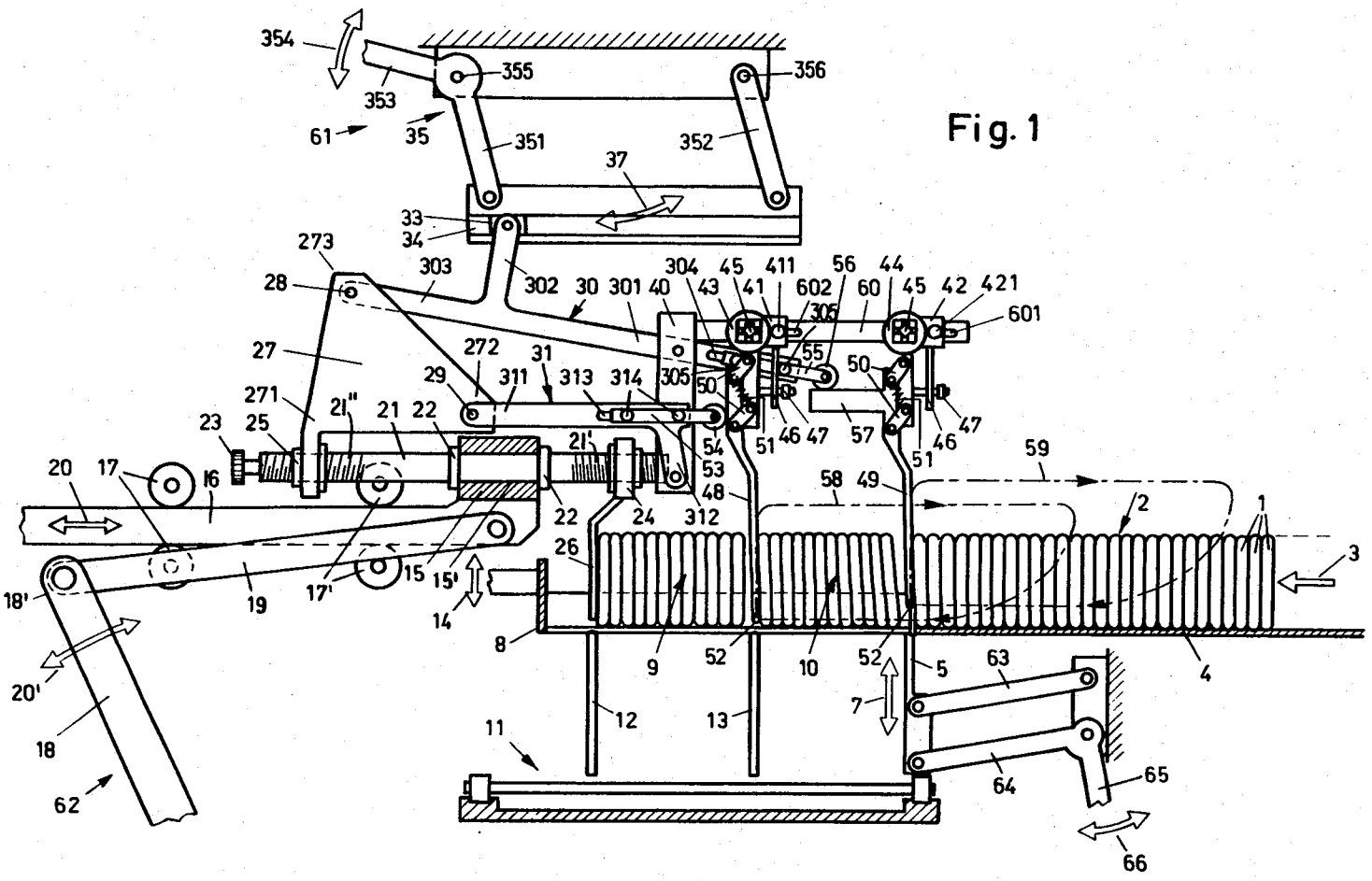
FIG. 1 is a schematic side elevational view of principal components of a preferred embodiment of the invention.
Figure 5:
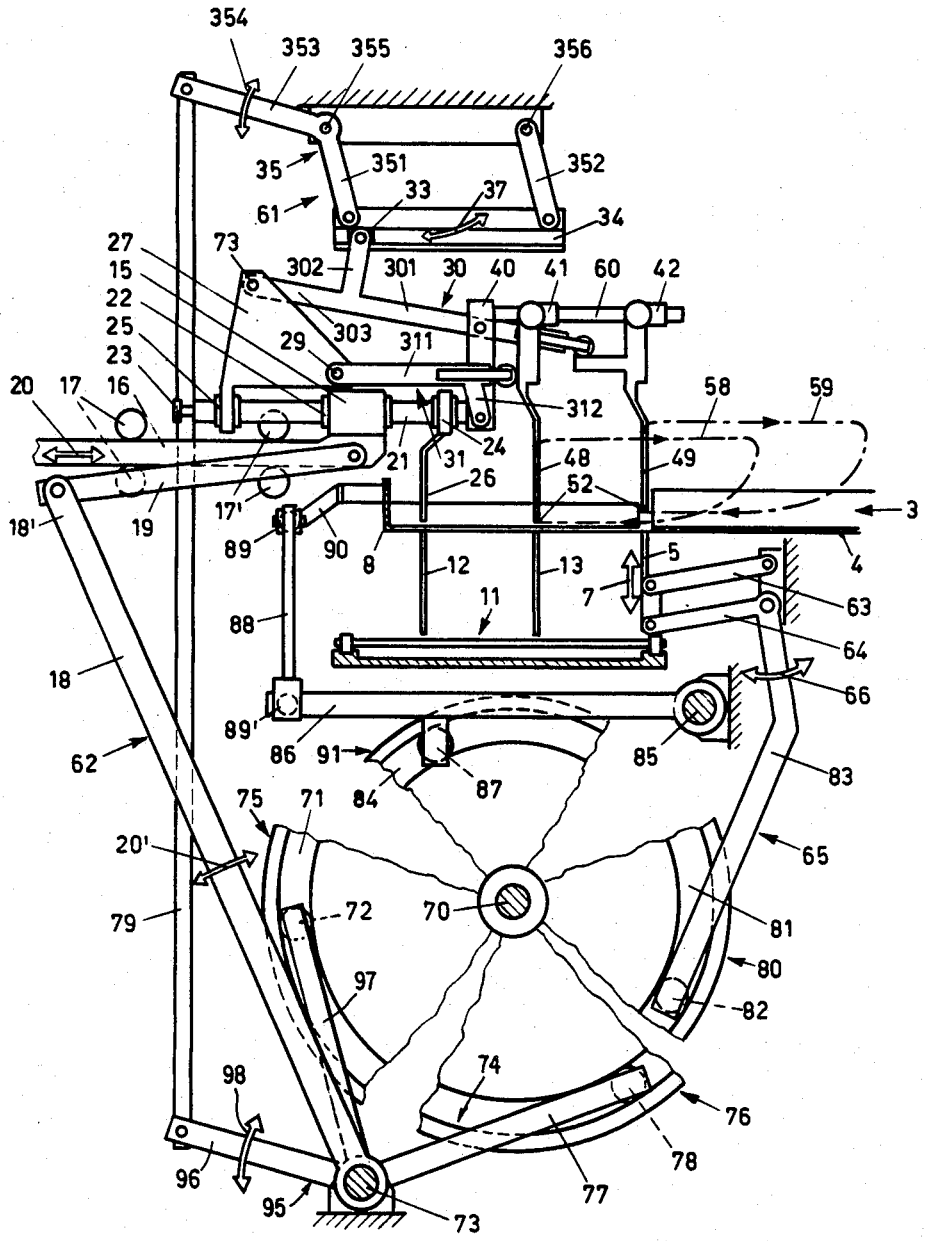
FIG. 5 is a schematic side elevational view of the preferred embodiment on a reduced scale compared to FIG. 1, including drive components.

Turning to FIGS. 1 and 5, the edgewise upright oriented articles 1 which form a stack 2, are advanced by a conveyor 4 in the direction of the arrow 3. The conveyor 4 may be a vibrating trough. As the stack 2 advances downstream, the leading article abuts a pickup element 26 which is moved with uniform speed in the conveying direction 3 by a bar 19 articulated to a lever 18. The arm 77 of the lever 18 carries a follower roller 78 which is guided in a cam track 74 of a cam disc 76.

At predetermined distances upstream of the pickup element 26 there are situated two separating elements 48 and 49 which have a conventional fork-like, blade-like or lance-like configuration. By means of a drive to be described in greater detail later, the separating elements 48 and 49 are driven in synchronism with the pickup element 26 to execute a motion along a path illustrated with dash-dot lines at 58, 59. Thus, at the upstream and downstream ends of their displacement the separating elements are introduced into the stack 2 and, respectively, withdrawn from between the article groups and the then leading end of the stack 2.

A transfer tray 8 whose length is designed to receive, in a roomy manner, both groups 9 and 10 formed between the pickup element 26 and the two separating elements 48 and 49, is movable as indicated by the arrow 14 along two separating rails 12 and 13 which are situated underneath the downstream end position of the pickup element 26 and the dowstream separating element 48, whereby both article groups 9 and 10 are, in a manner separated from one another, deposited on a conveyor 11 on which there may be prepositioned a packaging box of the earlier-noted construction.

A retainer 5, articulated to parallelogram bars 63 and 64 is displaced as indicated by the arrow 7, downstream of the stack 2 and upstream of the group 10 by means of a bell crank lever 83 which is oscillated by means of a drive 65 in the direction of the arrow 66. This permits the separating elements 48 and 49 to be withdrawn from between the articles 1 without causing unintended displacement of the articles. The drive 65 encompasses the above-noted bell crank lever 83 which, by means of a follower roller 82 carried on its free end, projects into a cam track 81 of a cam disc 80.

Two drives 61 and 62 effect the motion of the separating elements 48 and 49 to cause the lower ends thereof to travel along the path indicated in dash-dotted lines 58 and 59. As noted before, the bell crank lever 18 oscillates as indicated by the arrow 20'. The bar 19 articulated to the end 18' of the lever 18 effects a back-and-forth motion of a shift bar 16, between two roller pairs 17 and 17' as indicated with arrow 20. A guide head 15 forming a one-piece member with the shift bar 16 is provided with a throughgoing passage 15' which extends parallel to the direction of motion indicated by the arrow 20. In the passage 15' there is supported a spindle 21 which, at its opposite end portions, is provided with oppositely oriented (left-hand and right-hand) threads 21' and 21''. The spindle 21 carries a flange 22 on both sides of the guide head 15 to prevent an axial displacement of the spindle 21 with respect to the guide head 15. On the spindle threads 21', 21'' there are mounted spindle nuts 24 and 25, respectively. A rotation of the spindle 21 effected by the operating knob 23 causes the spindle nuts 24 and 25 to move either towards or away from one another. The pickup element 26 is rigidly affixed to the spindle nut 24 which, in its position illustrated in FIG. 1, is situated at the end of the spindle 21. By virtue of this arrangement, the pickup element 26 is moved back and forth by the drive 62 in a direction parallel to the arrow 3.

A carrier plate 27 of triangular configuration is fixedly attached at one corner 271 to the spindle nut 25. To the corner 272 of the carrier plate 27 there is articulated one end of the longer arm 311 of a bell crank lever 31. To the end of the shorter arm 312 of the bell crank lever 31 there is articulated one end of an elongated, plate-shaped separating element carrier 40.

One end of a short arm 303 of a three-armed lever 30 is articulated to the corner 273 of the carrier plate 27. The long arm 301 of the lever 30 is in linear alignment with the short arm 303. The third arm 302 of the lever 30 extends perpendicularly to the arms 301 and 303. The separating element carrier 40 is articulated, adjacent its upper end, to the arm 301 at a distance from the outer end thereof. The arm 302 of the lever 30 is, at its outer end, articulated to a slide block 33 guided in a rail 32.

The rail 34 forms part of the drive 61 and is swingably supported by two parallel bars 351 and 352 suspended from stationarily held pivots 355 and 356. The bar 351 constitutes one arm of a bell crank lever 35. The other arm 353 of the bell crank lever 35 is articulated to a bar 79 which, in turn, is jointed to an arm 96 of a bell crank lever 95 pivotally attached to the stationary pin 73 which also supports the lever 18 of the drive 62. The other arm 97 of the bell crank lever 95 carries a follower roller 72 which is guided in a cam track 71 of a cam disc 75, as a result of which the bell crank lever 95 oscillates as indicated by the arrow 98. This causes the lever 35 to oscillate in the direction of the arrow 354 about the pin 355, whereupon the rail 34 describes an arcuate motion as indicated by the arrow 37.

The arcuate motion of the rail 34 is, by means of the guide block 33, transmitted to the three-armed lever 30 so that the separating element carrier 40, in addition to a back-and-forth motion effected by the drive 62, also describes an up-and-down motion, effected by the drive 61.

A carrier bar 60 is secured to the separating element carrier 40. In longitudinal slots 601, 602 of the carrier bar 60 there are slidably supported carrier plates 41 and 42 by means of tightenable elements 411, 421, such as tightening screws. On the carrier plates 41 there are resiliently supported respective carrier levers 43, 44 by means of spring support arrangements 45. Such spring supports are of known construction and comprise, for example, four rubber blocks disposed in the four corners of a quadratic opening and the element to be supported, such as the carrier levers 43 and 44 extend with quadratic pins between the four rubber blocks. The separating elements 48 and 49 are connected with the two carrier levers 43 and 44 by means of pairs of parallel arranged links 50. The spring supports 45 may be pre-tensioned by means of the carrier levers 43 and 44 by virtue of the fact that on the carrier plates 41 and 42 there are secured perpendicularly downwardly projecting abutment bars 46 and the carrier levers 43 and 44 each have a stationary setting device 47 formed of a threaded bar and a setting nut.

The two link pairs 50 are biased by means of respective tensioning springs 51 between diagonally arranged pins such that the separating elements 48 and 49 are biased towards the associated respective carrier lever 43 or 44.

The longer arm 311 of the bell crank lever 31 is articulated to the corner 272 of the carrier plate 27 by means of a pivot pin 29 and carries, in a longitudinal slot 313, a bar 53 which is displaceably held in the slot 313 by means of two pins 314. The bar 53, at its end projecting beyond the lever 31, rotatably supports a roller 54 which engages a downstream-oriented edge face of the separating element 48.

The arm 301 of the three-armed lever 30 has a longitudinal slot 304 in which a bar 55 is slidably supported by means of two pins 305. At its free end the bar 55 rotatably supports a roller 56 which engages an arm 57 affixed to the separating element 49 and oriented in the direction of article advance.

During an operational phase described later, by means of the rollers 54 and 56 a force is exerted on the two separating elements 48 and 49 against the conveying direction of the articles to form an intermediate space between the groups 9 and 10 and between the group 10 and the stack 2 by shifting the articles, located upstream of the respective separating elements 48 and 49 in a direction against the normal direction of advance (that is, opposite to the direction indicated by the arrow 3).

In order to ensure that during lifting and lowering the separating elements 48 and 49, no damage to the articles engaged by the separating elements occurs, the tips of the separating elements 48 and 49 are, in a known manner, provided with rotatably supported rollers 52.

For effecting motion of the transfer tray 8 in the direction of the arrow 14, the tray 8 is affixed to a lever 90 which is rotatably supported in a ball joint 89 of a connecting rod 88. The connecting rod 88 is, by means of a ball joint 89' articulated to a one-arm lever 86 swingably supported by a stationary pivot 85. The lever 86 carries a follower roller 87 which projects into a cam track 84 of a cam disc 91.

Figure 2:
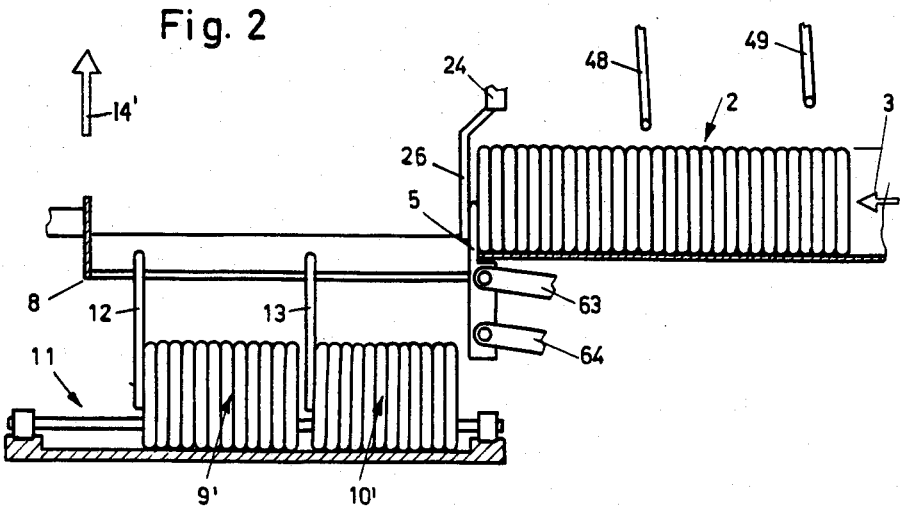
FIGS. 2, 3 and 4 are sectional elevational views of components of the preferred embodiment depicted in different operational positions.
Figure 3:
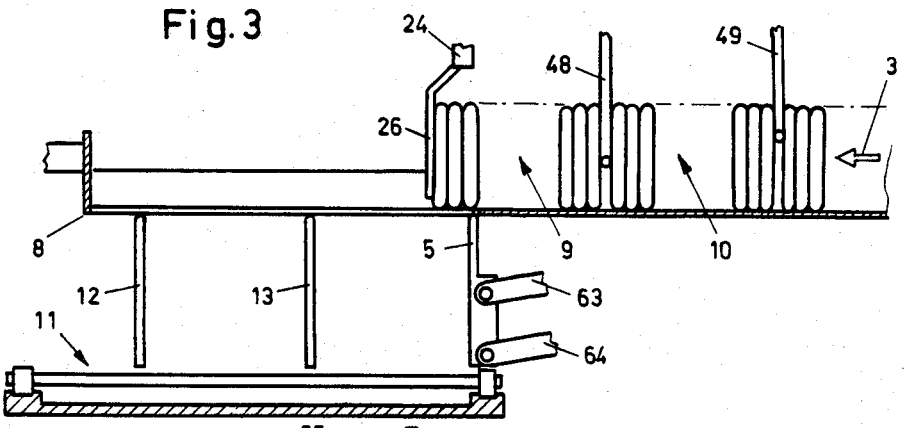
Figure 4:
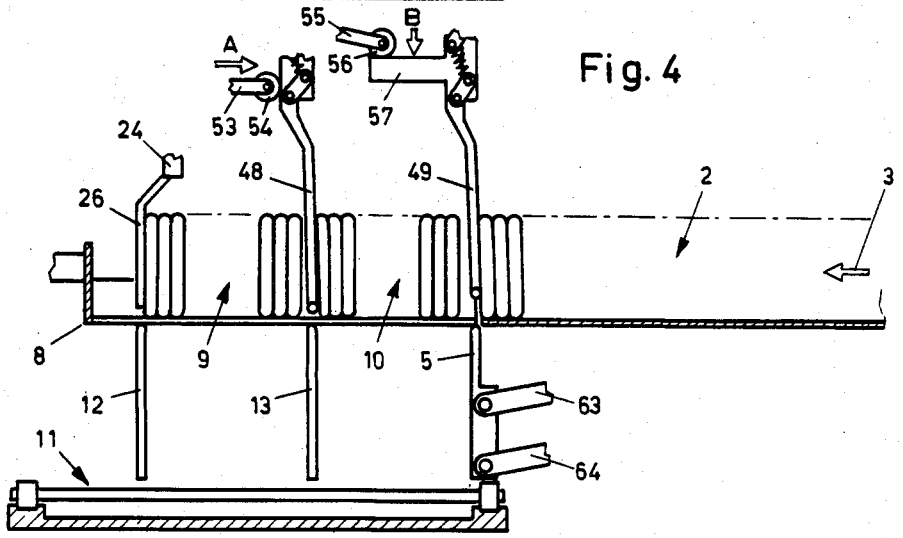

In the description which follows, the operation of the above-described apparatus will be set forth, with particular reference to FIGS. 2, 3 and 4.

Turning to FIG. 2, the displacement of the stack 2 in the direction of the arrow 3 is stopped by the raised retainer 5. The two separating elements 48 and 49 are situated in their upstream position above the stack 2. The pickup element 26 too, is in its upper position immediately downstream of the retainer 5. The transfer tray 8 is depicted shortly before attaining its upper end position and is in the process of moving in the direction of the arrow 14'. The two separated groups 9' and 10' thus lie on the conveyor apparatus 11 and are held in a separated state by the two rails 12 and 13.

A subsequent operational phase illustrated in FIG. 3 shows the pickup element 26 and the two separting elements 48 and 49 in a position which is downstream of their starting position shown in FIG. 2. The two separating elements 48 and 49 have penetrated to a predetermined extent into the stack 2 and at that time two new groups 9 and 10 have been separated from the stack 2. By virtue of the fact that the downstream separating element 48 is longer than the separating element 49, the initial penetration of the separating elements 48 and 49 into the stack 2 occurs at different moments.

FIG. 4 shows the lowermost downstream position of the pickup element 26 and the separating elements 48 and 49. In preparation for the removal of the separating elements 48 and 49 from the formed groups, the rollers 54 and 56 press on the separating element 48 and on the lever 57 of the separating element 49 as indicated by respective arrows A and B. This causes the lower ends of the separating elements 48 and 49, that is, the rollers 52, to be pressed in a direction opposite the article advancing direction 3 whereby intermediate spaces are formed so that the retainer 5 may be brought up into its operative position and the two groups 9 and 10 may be deposited on the conveyor 11 by the downwardly moving tray 8 on each side of the separating rail 13 to subsequently assume the position shown in FIG. 2.

The drives 61 and 62 for the pickup element 26 and for the separating elements 48, 49 as well as the drives 65 and 67 for the retainer 5 and the transfer tray 8, respectively, driven by the four cam discs 75, 76, 80 and 81 are synchonized in their displacements by virtue of the fact that the four cam discs 75, 76, 80 and 81 are fixedly mounted on the drive shaft 70.

It is to be understood that the carrier bar 60 may be made longer to accept additional separating elements. Similarly, by extending the bar 55, additional separating elements may be pressed against the advancing direction of the articles.

It will be understood the above description of the present invention is susceptible to various modifications, changes and adaptations, and the same are intended to be comprehended within the meaning and range of equivalents of the appended claims.

What is claimed is:

1. An apparatus for separating article groups of predetermined length from an article stack of indefinite length, comprising:

(a) first conveyor means for advancing the article stack in a conveying direction;

(b) a pickup element arranged for a back-and-forth displacement parallel to said conveying direction and for being periodically abutted by a momentarily leading article of said stack;

(c) first driving means for imparting said back-and-forth motion to said pickup element;

(d) a separating assembly situated upstream of said pickup element and including at least two separating elements spaced from one another parallel to said conveying direction and being displaceable as a unit;

(e) second driving means for moving said separating elements towards said first conveyor means generally perpendicularly to said conveying direction to introduce said separating elements into the article stack for forming a first article group between said two separating elements and a second article group between said pickup element and the separating element adjacent said pickup element and for moving said separating elements in synchronism with said pickup element, in said conveying direction away from said first conveyor means;

(f) a transfer tray situated immediately downstream of said first conveyor means as viewed in said conveying direction and arranged for receiving said article groups moved by said separating elements during their displacement in said conveying direction;

(g) second conveyor means situated adjacent said transfertray;

(h) means for effecting transfer of said article groups simultaneously from said transfer tray to said second conveyor means; and (i) means situated between said transfer tray and said second conveyor means for maintaining said groups separated from one another during their transfer from said transfer tray to said second conveyor means.

2. An apparatus as defined in claim 1, further comprising (j) a retaining means situated between said first conveyor means and said transfer tray; said retaining means having an operative position in which it abuts a leading article of the stack for retaining the stack on said first conveyor means while said article groups are moved away from the article stack by said separating elements; said retaining means further having an inoperative position in which it is withdrawn from said first conveyor means; and (k) third driving means for moving said retaining means alternatingly into said operative and inoperative positions in synchronism with said first and second driving means.

3. An apparatus as defined in claim 1, wherein the separating element situated adjacent said pickup element is longer than the separating element situated in an extreme upstream position as viewed in said conveying direction.

4. An apparatus as defined in claim 1, further comprising support means being driven by said second driving means and carrying said separating elements; said support means including a common support bar and resilient supporting element means for suspending each said separating element from said common support bar and for permitting each said separating element a pivotal motion in a vertical plane through a limited angle; said second driving means including two drives operatively coupled to said common support bar for effecting simultaneous displacements of said separating elements.

5. An apparatus as defined in claim 4, further comprising separate pressing means forming part of said second driving means and being operatively connected with each said separating element for effecting a limited pivotal motion of the separating elements in a direction opposite to said conveying direction when said separating elements are closest to said first conveyor means, for slightly displacing articles against said conveying direction.

6. An apparatus as defined in claim 1, further comprising adjusting means for varying the distance between said pickup element and the separating element adjacent said pickup element.

7. An apparatus as defined in claim 6, further comprising a guide head forming part of said first driving means; said adjusting means including (a) a spindle rotatably supported in said guide head and having oppositely threaded first and second length portions; said spindle extending parallel to said conveying direction;

(b) a first nut threadedly engaging said first length portion of said spindle; said pickup element being rigidly affixed to said first nut;

(c) a second nut threadedly engaging said second length portion of said spindle;

(d) a carrier element affixed to said second nut;

(e) a lever pivotally connected to said carrier element and operatively coupled to said separating element adjacent said pickup element; and (f) means for rotating said spindle for effecting simultaneous travel of said first and second nut towards or away from one another.

* * * * *